US006386694B2

(12) United States Patent
Kawakami

(10) Patent No.: US 6,386,694 B2
(45) Date of Patent: May 14, 2002

(54) IMAGE FORMING APPARATUS AND ITS INK CARTRIDGE

(75) Inventor: Osamu Kawakami, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/739,264

(22) Filed: Dec. 19, 2000

(30) Foreign Application Priority Data

Dec. 20, 1999 (JP) ..... 11-361396

(51) Int. Cl.[7] ..... B41J 2/175

(52) U.S. Cl. ..... 347/86

(58) Field of Search ..... 347/19, 20, 85, 347/86, 87

(56) References Cited

FOREIGN PATENT DOCUMENTS

| | | | | |
|---|---|---|---|---|
| JP | 5-224479 | | 9/1993 | |
| JP | 409104116 A | * | 4/1997 | ..... B41J/2/175 |
| JP | 9-185311 | | 7/1997 | |
| JP | 11043167 A | * | 2/1999 | ..... B65D/49/00 |

* cited by examiner

*Primary Examiner*—Anh T. N. Vo
(74) *Attorney, Agent, or Firm*—McGinn & Gibb, PLLC

(57) ABSTRACT

An image forming apparatus for forming an image comprises an attaching section, a sensor, a memory, a print section, and a controller. An ink cartridge is attached to the attaching section. The ink cartridge contains ink from a supply port on which a display member which displays a predetermined image is adhered. The sensor obtains image data of the display member adhered to the attached ink cartridge to output the obtained image data. The memory stores image data of an image displayed on the display member adhered to a genuine ink cartridge. The print section prints a desired image. The controller determines whether or not image data outputted from the sensor substantially matches image data stored in the memory to allow the print section to perform printing when both image data match each other. An ink cartridge of an image forming apparatus, which is attachable and removable to/from the image forming apparatus, contains ink from a supply port. The ink cartridge comprises a display member having a predetermined image. The display member is adhered to the supply port and broken by a peeling force from the supply port.

14 Claims, 8 Drawing Sheets

IMAGE FORMING APPARATUS AND ITS INK CARTRIDGE

BACKGROUND OF THE INVENTION

1. Field of the Invention

The present invention relates to an image forming apparatus and its ink cartridge, and more particularly to an image forming apparatus capable of preventing an illegal use of the cartridge and the use of a defective ink cartridge, and its ink cartridge.

2. Description of the Related Art

As the widespread use of image forming apparatuses such as a printer, a copy machine, a facsimile machine and the like, the amount of ink cartridge consumed has been increased. Ink hereinafter indicates toner, liquid in which toner is diffused to a liquid solvent, an ink ribbon (tape) and the like which are used to form an image on a recording paper.

When ink in the ink cartridge runs out, a user replaces the ink cartridge with new one. Manufacturers of the image forming apparatuses have recycled the used ink cartridges for the purpose of the effective use of resource and an environmental protection.

The quality of ink cartridge exerts an influence upon a printing quality of the image forming apparatus. For example, when the cartridges are recycled without providing sufficient maintenance, color fading, inconsistencies in print density and so on are generated in the output image of the image forming apparatus. For this reason, the manufacturers have performed various kinds of maintenance processing of the cartridges, such as inspection, cleaning, replacement of parts, print test, and like at the time of recycling. Therefore, as long as the ink cartridge recycled by the manufacturer (genuine cartridge) is used, a normal image forming can be generally obtained.

While, the ink cartridges provided by the third party other than the manufacturer and the defective toner-filled cartridges to which neither inspection nor replacement of parts are performed have been put on the market. Such ink cartridges, however, are easily to generate troubles such as wherein print quality is reduced, no printing can be carried out, no ink can be used up. When such troubles occur, the user asks the manufacturer, which provides genuine cartridges in general. For this reason, though the manufacturer sells the genuine cartridges, the manufacturer is involved in the trouble caused by the use of illegal cartridge. Moreover, the user cannot receive guarantee against the defective product from the third party.

The image forming apparatuses to overcome such inconvenience are disclosed in, for example, Unexamined Japanese Patent Application KOKAI Publication Nos. H5-224479 and H9-185311.

The image forming apparatus disclosed in Unexamined Japanese Patent Application KOKAI Publication No. H5-224479 scans a bar code indicated on the ink cartridge and determines whether or not the cartridge is genuine. Then, when it is not genuine, a defective image is printed so as to substantially prohibit the use of non-genuine product. However, since the manufacture of bar code can be easily attained, illegal manufactures can relatively easily counterfeit the bar code and adhere the counterfeit bar code to the recycled cartridge to be sold. Therefore, the above cannot prevent the use of the non-genuine ink cartridge effectively.

The image forming apparatus disclosed in Unexamined Japanese Patent Application KOKAI Publication No. H9-185311 has a plurality of switches at a surface contacting the cartridge. The cartridge has specific concave and convex portions at a surface contacting the image forming apparatus. When the cartridge is attached to the image forming apparatus, a specific switch is turned on. The image forming apparatus detects an ON/OFF pattern of the switch, whereby determining whether or not the attached ink cartridge is a genuine product. Then, when it is not a genuine product, the image forming apparatus prohibits the use. However, in the case of reusing the used cartridge collected, since the concave and convex portion formed on the cartridge are unchanged, the use of the cartridge cannot be prevented. Therefore, the illegal reuse of the cartridge cannot be prevented.

SUMMARY OF THE INVENTION

The present invention has been made with consideration given to the abovementioned problems, and an object of the present invention is to provide an image forming apparatus capable of preventing the use of an illegal or defective ink cartridge, and its ink cartridge.

Also, another object of the present invention is to provide an image forming apparatus capable of preventing the use of ink cartridges other than a predetermined ink cartridge, and its ink cartridge.

Further another object of the present invention is to provide an image forming apparatus capable of ensuring the formation of high quality image using a recycled ink cartridge.

In order to attain the above object, according to the first aspect of the present invention, there is provided an image forming apparatus for forming a desired image, the image forming apparatus comprises: an attaching section for attaching an ink cartridge, which contains ink from a supply port and which has a display member for displaying a predetermined image adhered to the supply port; a sensor for obtaining image data of the display member adhered to the attached ink cartridge to output the obtained image data; a memory for storing image data of an image displayed on the display member adhered to a genuine ink cartridge; a print section for printing said desired image; and a controller for determining whether or not image data outputted from the sensor substantially matches image data stored in the memory to allow the print section to perform printing when both image data match each other.

Moreover, according to the second aspect of the present invention, there is provided an ink cartridge of an image forming apparatus, which is attachable and removable to/from the image forming apparatus and which contains ink from a supply port, the ink cartridge comprising a display member, which is adhered to the supply port, broken by a peeling force from the supply port, and which has a predetermined image.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

The preferred embodiment of the present invention will be specifically explained with reference to the accompanying drawings.

Figure 1:
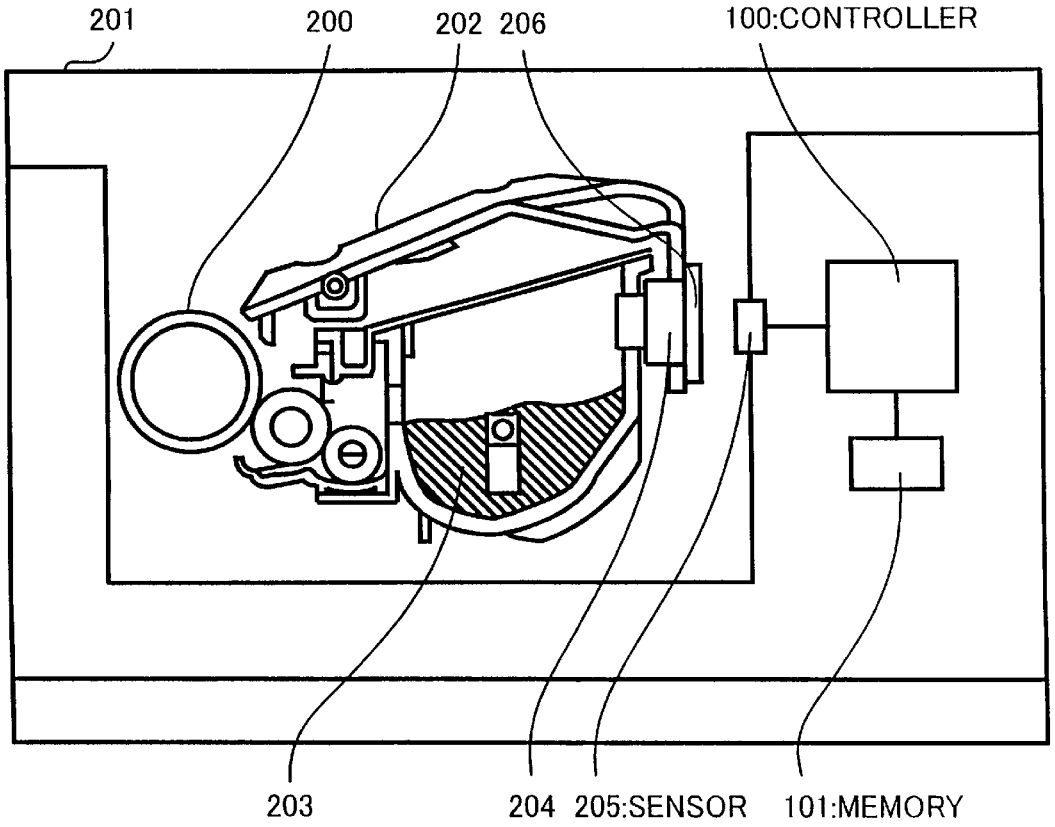
FIG. 1 is a cross-sectional view showing a configuration of each of the image forming apparatus and its ink cartridge according to an embodiment of the present invention.

FIG. 1 is a cross-sectional view showing a configuration of each of the image forming apparatus and its ink cartridge according to an embodiment of the present invention.

An ink cartridge (hereinafter referred to as cartridge) 202 is attached to an image forming apparatus 201. The cartridge 202 contains toner 203 as ink.

The image forming apparatus 201 performs light-exposure process, developing process, fixing process to print image data inputted or original on a recording paper. Namely, the image forming apparatus 201 forms an electrostatic latent image on a photo-conductor drum 200, adheres toner 203 to the electrostatic latent image to form a visible image (toner image), and fixes the toner image on the recording paper. In addition, the known structure can be arbitrarily used as a structure for forming (printing) the image.

The image forming apparatus 201 also comprises a controller 100, a memory 101, and a sensor 205 in order to identify whether the attached cartridge 202 is a genuine product.

The cartridge 202 has an toner supply port 204 through which toner can be supplied. The toner supply port 204 is closed with a cap 204*a*, and a seal 206 is adhered thereto as shown in a plane of FIG. 2. A trademark 206*a* of a company, which provides a genuine cartridge 202, is printed on the seal 206. The seal 206 assures that the cartridge 202 is a genuine consumable item of the image forming apparatus 201. The seal is structured to be easily removed (destroyed) by a user or a machine at the time of detaching the cap 204*a*.

Figure 3:
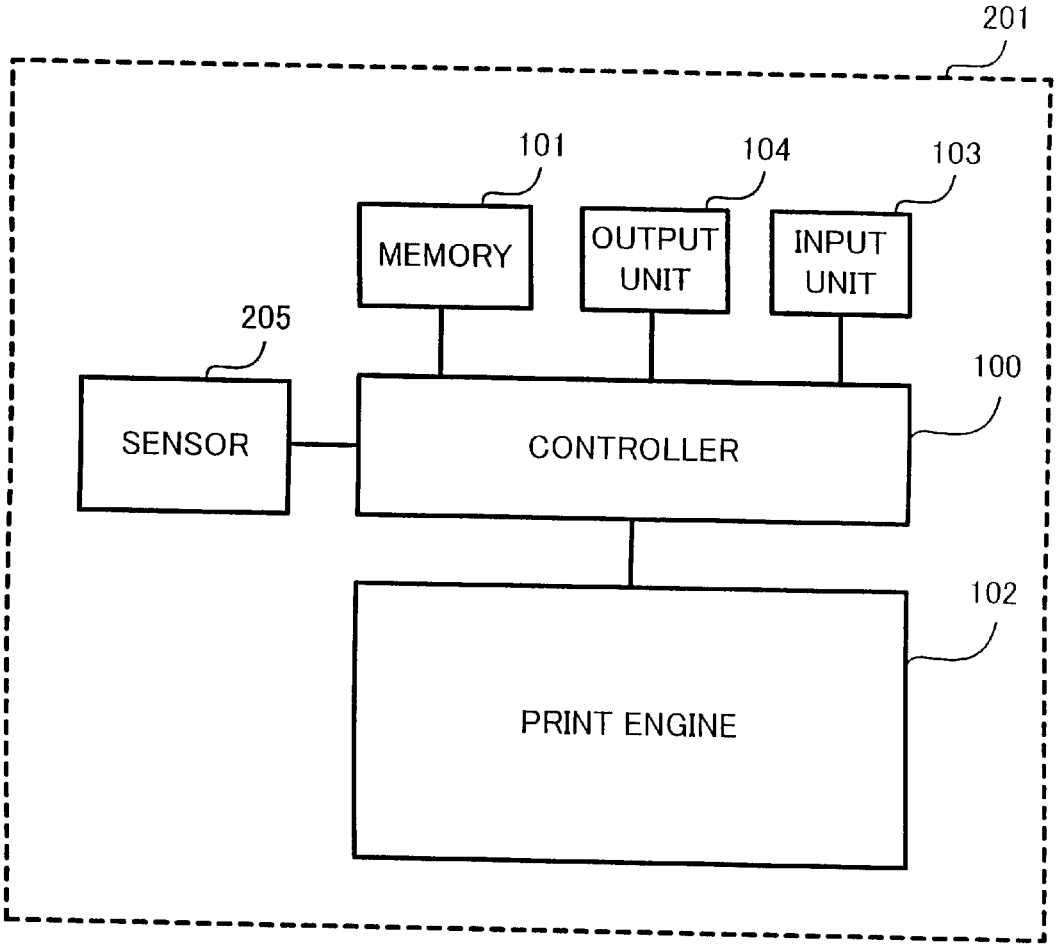
FIG. 3 is a block diagram showing a circuit structure of the image forming apparatus according to the embodiment of the present invention.

FIG. 3 is a block diagram showing a circuit structure of the image forming apparatus 201. As illustrated therein, the image forming apparatus 201 comprises the controller 100, the memory 101 connected to the controller 100, a print engine 102, an input unit 103, an output unit 104, and the sensor 205.

Figure 2:
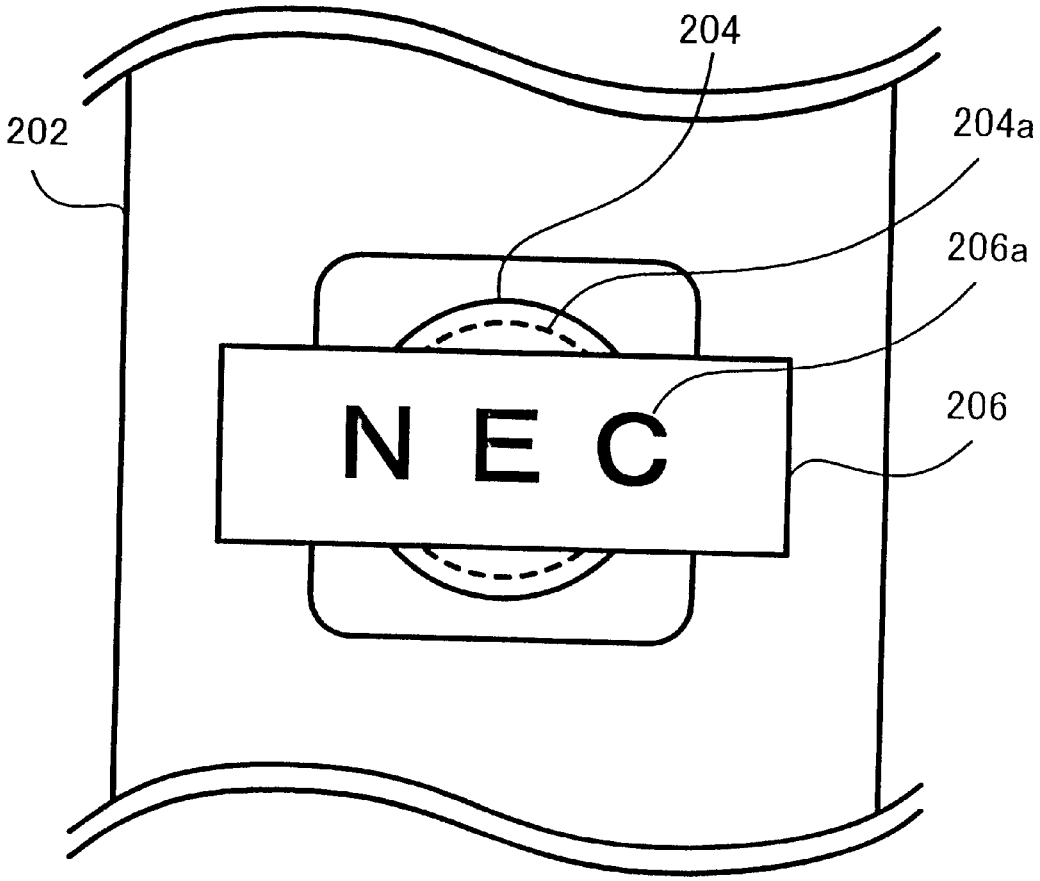
FIG. 2 is a front view of a toner supply port to which a seal is adhered.

In the memory 101, image data of the trademark 206*a*, which is printed on the seal 206 shown in FIG. 2, is registered.

The print engine 102 includes the photo-conductor drum 200, a light-exposure unit, a developing unit, and a fixing unit, and executes processes for an image forming such as exposure to light, developing, and fixing.

The input unit 103 inputs an instruction to start printing and sends it to the controller 100.

The output unit 104 includes a display unit, a speaker and the like, and outputs arbitrary information.

Figure 4:
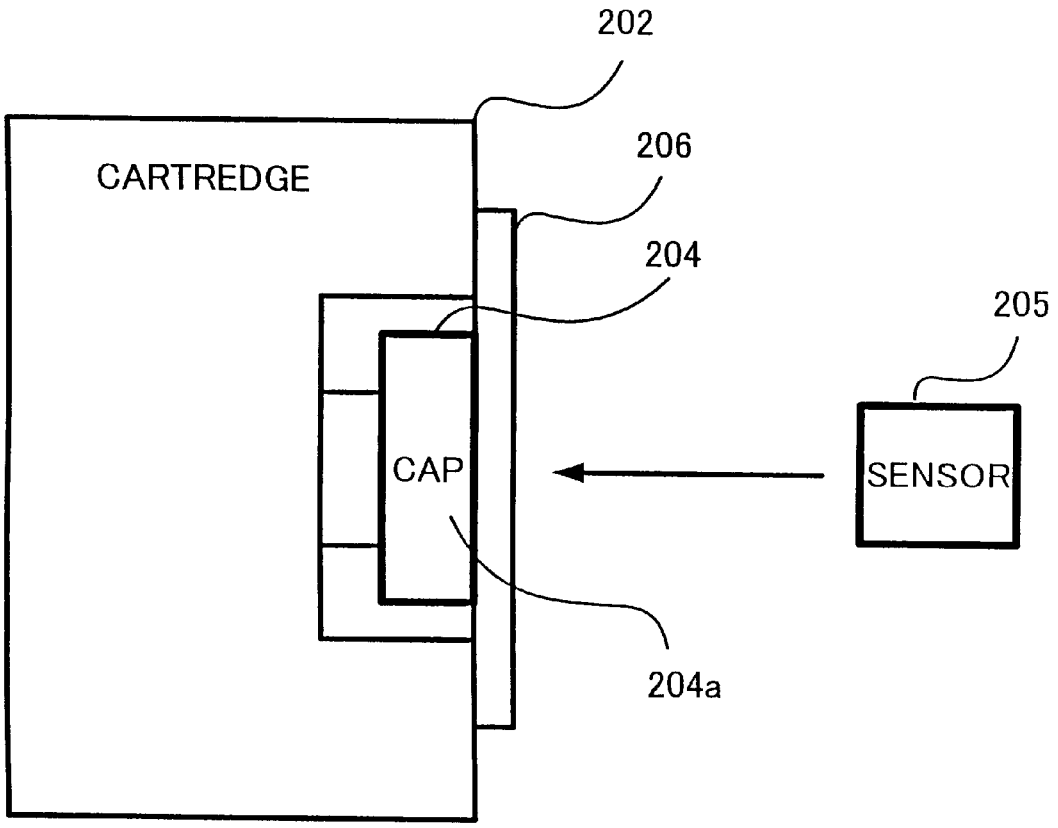
FIG. 4 is a view showing the positional relationship between the toner supply port to which a seal is adhered and an image sensor.

The sensor 205 comprises an artificial retina LSI and a lens, or the like. The sensor 205 faces the toner supply port 204 as shown in FIG. 4 while the cartridge 202 is installed in the image forming apparatus 201. The sensor 205 converts captured image into image data, and supplies the image data to the controller 100.

The controller 100 shown in FIG. 3 determines whether or not image data outputted from the sensor 205 substantially matches image data of the trademark registered in the memory 101 by, for example, pattern matching. When both image data match each other, the controller 100 sets the print engine 102 to a print standby state, and causes the print engine 102 to execute the print operation after the instruction to start printing is inputted from the input unit 103. When both image data do not match each other, the controller 100 does not cause the print engine 102 to execute the print operation even if the instruction to start printing is inputted from the input unit 103.

The image forming apparatus 201 operates as follows.

A normal operation will be first explained.

When the cartridge 202 to which the seal 206 is adhered is attached to the image forming apparatus 201 and power is turned on, the seal 206 is within a visual field of the sensor 205 and the sensor 205 outputs image data of an image on the seal 206 to the controller 100.

The controller 100 determines whether or not image data outputted from the sensor 205 matches image data of the trademark registered in the memory 101. When both image data match each other, the controller 100 sets the print engine 102 to a print standby state, and waits for the supply of a print start command from the input unit 103. Then, when the controller 100 receives the print start command, the controller 100 supplies image data to the print engine 102 to execute the print operation.

When the user repeats the printing and the toner 203 in the cartridge 202 runs out, the user replaces the cartridge with new one. The image forming apparatus 201 provides the same operation as mentioned above to the cartridge 202 newly set.

While, the used cartridges 202 is collected by the manufacturer of the image forming apparatus 201 (or a person who is licensed from the manufacturer). Then, the seal 206 is peeled from the cartridge. The used cartridge 202 is subjected to various processes such as disassembly (as required), inspection, replacement of detective parts (as required), cleaning, assembly, and the like to be recycled.

Toner 203 is supplied to the recycled cartridge 202 from the toner supply port 204, and the toner supply port 204 is closed with the cap 204*a*. Finally, the seal 206 is adhered the cartridge, with the result that the recycled toner cartridge 202 is completed.

The cartridges 202 thus recycled are sold to the consumers. When the user sets the recycled cartridge 202 to the image forming apparatus 201, the same operation as mentioned above is executed, the normal printing is carried out by the image forming apparatus 201.

While, there is a case in which the used cartridges 202 are collected by a person who has no authority to recycle the cartridges 200. In this case, the recycler peels the seal 206 on the toner supply port 204. Then, toner 203 is supplied to the cartridge 202 from the supply port 204 and the resultant cartridge is sold. However, even if this cartridge is set to the image forming apparatus 201, the controller 100 determines that image data sent from the sensor 205 does not match image data registered in the memory 101 and prohibits the printing since the seal is not adhered to the cartridge 202. In other words, the cartridge 202, which is recycled by the person with no authority, cannot be used.

Figure 5:
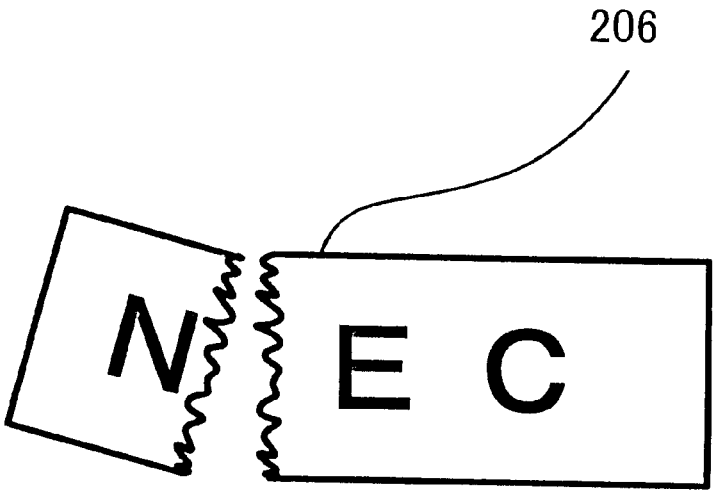
FIG. 5 is a view showing an example of a damaged seal.
Figure 6:
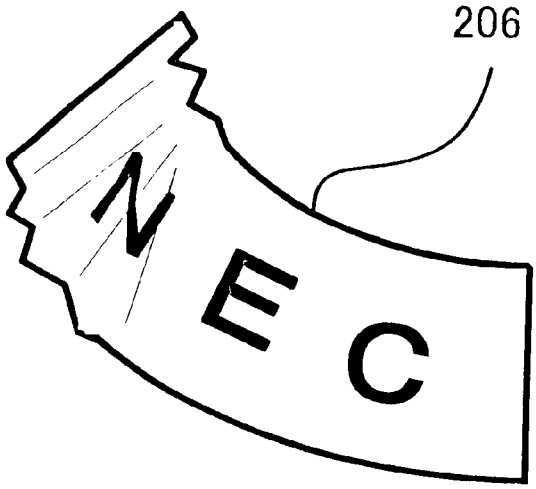
FIG. 6 is a view showing an example of a damaged seal.

Even if the recycler or the user tries to adhere the seal 206 to the recycled cartridge 202, the seal 206 is broken as shown in FIG. 5 or distorted as shown in FIG. 6 by a peeling force at a toner supply time, and this makes it difficult to reuse the seal 206. Moreover, even if the seal 206 is forcefully adhered to the toner supply port 204, the trademark on the seal 206 is distorted and blurred. As a result, the controller 100 determines that image data sent from the sensor 205 does not match image data registered in the memory 101.

Furthermore, if the person with no authority replicates the seal 206 and adheres it to the cartridge 202, this is the use of trademark by a person other than the trademark owner, namely, infringement of trademark right. Therefore, the cartridge to which the replicated seal is adhered cannot be put on the market.

As explained above, the image forming apparatus 201 of this embodiment allows the printing only when the cartridge to which the seal 206 with trademark right is adhered is attached to the image forming apparatus 201. Then, when the adhered seal 206 is broken or a mark on the seal 206 cannot be recognized, the image forming apparatus 201 prohibits the printing. Therefore, only the manufacturer, who can recycle the cartridge 202 with the responsibility (guarantee the quality of the recycled product), and the person, who is licensed from the manufacturer, can supply the recycled cartridge. In other words, the use of the illegal or defective cartridge can be prevented, the use of the ink cartridge other than the ink cartridge to which the trademark label is adhered can be stopped, and the formation of high-quality image can be assured using the recycled ink cartridge.

Additionally, in the above explanation, the image forming apparatus 201 prohibits the printing when the non-genuine cartridge is attached to the image forming apparatus. However, the user cannot understand what has happened from this event, and there is a possibility that this will lead to a misunderstanding in which the image forming apparatus 201 is faulty. In order to avoid such a possibility, it is possible to inform the user of the reason why the image forming apparatus 201 does not normally operate when the non-genuine cartridge is attached thereto (the attached cartridge is not a genuine product).

In this case, the memory 101 stores display data, for example, a message "use a genuine product" as a warning message together with image data of the trademark.

The controller 100 determines whether or not image data outputted from the sensor 205 does not match image data of the trademark registered in the memory 101. When both data do not match each other, the print engine 102 is driven to print the message on the printing paper based on display data stored in the memory 101. The controller 100 executes the print operation when the power of image forming apparatus 201 is turned on, the cartridge 202 is set to the image forming apparatus 201, and the print start command is received.

Furthermore, the image forming apparatus 201 may output the above message by the image or voice using the output unit 104. In this case, when image data outputted from the sensor 205 does not match image data of the trademark registered in the memory 101, the controller 100 reads the message data stored in the memory 101 and sends the read message data to the output unit 104 by which the message data is displayed or outputted by voice. Or, a simple warning sound may be outputted from the output unit 104.

According to the aforementioned structure, the user can know the reason why the image forming apparatus 201 does not normally operate. In addition, after printing/displaying/emitting the warning message, the normal print operation may be carried out.

Figure 7:
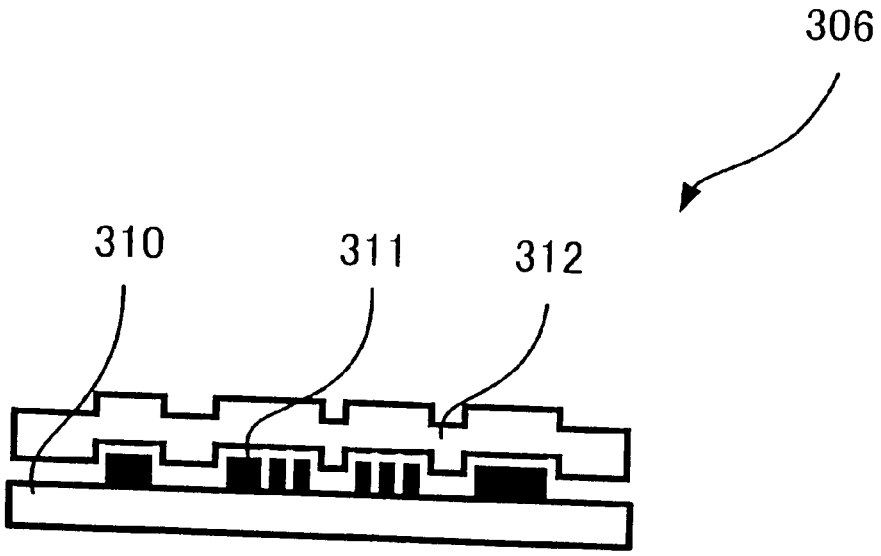
FIG. 7 is a cross-sectional view showing a section of a seal.
Figure 8A:
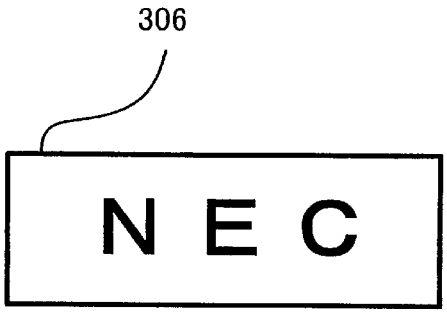
FIG. 8A is a view showing an example of a broken trademark on the seal.
Figure 8B:
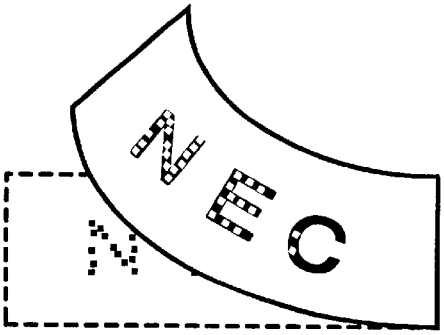
FIG. 8B is a view showing an example of a broken trademark on the seal.

A seal to be adhered to the cartridge may be composed of adhesive 310, ink 311 forming the trademark, and a protection sheet 312 as illustrated by, for example, the cross-sectional view of FIG. 7. When a seal 306 is peeled, ink is partially peeled from the protection sheet 312 by a peeling force as shown in a change from FIG. 8A to FIG. 8B, and is left on the toner supply port 204, with the result that the seal 306 cannot be reused.

In the aforementioned embodiment, the sensor 205, which is formed of an artificial retina LSI, has been used. However, any sensor, for example, a magnetic sensor, a chemical sensor, color image sensor, and so on may be used if the sensor can recognize the trademark for specifying the cartridge.

This invention is not limited to the aforementioned embodiment, and various modifications and applications are possible. In the above embodiment, the dry type image forming apparatus using toner has been explained. However, any type may be used if it is an image forming apparatus and its cartridge such an ink jet type or wet type image forming apparatus, a dot-matrix printer and the like.

Figure 9:
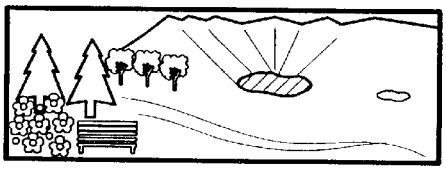
FIG. 9 is a view showing an example of an image to be displayed on the seal.
Figure 10:
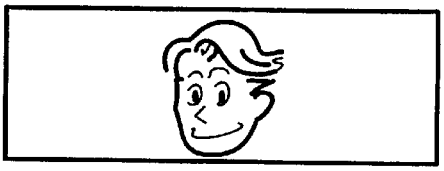
FIG. 10 is a view showing an example to an image to be display on the seal.

In addition, the mark displayed on the seal 206 is not limited to "trademark." Any mark may be applied if the mark is replicated and put on the market to infringe on the rights of others. For example, an original image having a copyright as shown in FIG. 9, and an image having a right of portrait as illustrated in FIG. 10 may be used.

Various embodiments and changes may be made thereunto without departing from the broad spirit and scope of the invention. The above-described embodiment intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. H11-361396 filed on Dec. 20, 1999 and including specification, claims, drawings and summary. The disclosure of the above Japanese Patent Application is incorporated herein by reference in its entirety.

What is claimed is:

1. An ink cartridge of an image forming apparatus, which is attachable and removable to/from the image forming apparatus and which contains ink from a supply port, said ink cartridge comprising a display member, which is adhered to said supply port during a print operation, wherein the display member is configured to be broken by a peeling force from said supply port, and which has a predetermined image.

2. The ink cartridge of the image forming apparatus according to claim 1, wherein a trademark is displayed on said display member.

3. The ink cartridge of the image forming apparatus according to claim 1, wherein an image having a copyright is displayed on said display member.

4. The ink cartridge of the image forming apparatus according to claim 1, wherein said display member comprises an adhesion layer, an image forming layer which is disposed on said adhesion layer and which is formed of ink to show an image, and a protection film for protecting a surface of said image forming layer, wherein said image forming layer is broken by the peeling force from said supply port.

5. The image forming apparatus according to claim 1, wherein the display member is adhered to said image forming apparatus during a print operation.

6. The image forming apparatus according to claim 5, wherein the display member is peeled from said supply port prior to a refill operation.

7. An image matching apparatus for determining a match between obtained image data and stored image data, said image forming apparatus comprising:

an attaching section for attaching an ink cartridge, which contains ink from a supply port and which has a display member for displaying a predetermined image adhered to said supply port;

a sensor for obtaining image data of said display member adhered to said attached ink cartridge to output said obtained image data;

a memory for storing the image data of the stored image displayed on the display member adhered to a genuine ink cartridge;

a print section for printing; and a controller for determining whether or not the image data outputted from said sensor substantially matches stored image data stored in said memory to allow said print section to perform printing when both image data match each other.

8. The image forming apparatus according to claim 7, wherein said memory further stores message data showing a message to further the use of said genuine ink cartridge, and when a mismatch is found between said output image data from said sensor and said stored image data stored in said memory, said controller reads said message data from said memory and sends the read message data to said print section to print the message data.

9. The image forming apparatus according to claim 7, further comprising a display section, wherein said memory further stores message data showing a message to further the use of said genuine ink cartridge when substantially a match is found, and when substantially a mismatch is found between output image data from said sensor and said stored image data stored in said memory, said controller reads said message data from said memory and sends the read message data to said display section to display the message data.

10. The image forming apparatus according to claim 7, further comprising a voice output unit for outputting a warning sound or a sound or a message to prevent the use of a non-genuine ink cartridge when said controller determines that a mismatch is found between output data from said sensor and said stored image data stored in said memory.

11. The image forming apparatus according to claim 7, wherein image data of the trademark is stored in said memory.

12. The image forming apparatus according to claim 7, wherein image data of the image having a copyright is stored in said memory.

13. The image forming apparatus according to claim 7, wherein the display member is adhered to said image forming apparatus during a print operation.

14. The image forming apparatus according to claim 13, wherein the display member is peeled from said supply port prior to a refill operation.

* * * * *